United States Patent [19]

Hori

[11] 4,238,077

[45] Dec. 9, 1980

[54] SPRAY NOZZLE FOR ELECTROSTATIC AIRLESS COATING

[75] Inventor: Nakaichi Hori, Owariasahi, Japan

[73] Assignee: Asahiokuma Sangyo Kabushiki Kaisha, Aichi, Japan

[21] Appl. No.: 968,005

[22] Filed: Dec. 8, 1978

[30] Foreign Application Priority Data

Oct. 17, 1978 [JP] Japan ..... 53/127677

[51] Int. Cl.[3] ..... B05B 5/00

[52] U.S. Cl. ..... 239/707

[58] Field of Search ..... 239/690, 704, 706, 707

[56] References Cited

U.S. PATENT DOCUMENTS

| | | | |
|---|---|---|---|
| 2,710,773 | 6/1955 | Sedlacsik | 239/707 |
| 3,263,127 | 7/1966 | Point | 239/707 X |
| 3,764,068 | 10/1973 | Lacchia | 239/707 X |

FOREIGN PATENT DOCUMENTS

| | | | |
|---|---|---|---|
| 2101123 | 8/1972 | Fed. Rep. of Germany | 239/706 |

*Primary Examiner*—Richard A. Schacher

*Attorney, Agent, or Firm*—Blair, Brown & Kreten

[57] ABSTRACT

A nozzle for an electrostatic airless coating spray gun comprises a circular orifice and a cylindrical holder provided concentrically with the orifice and defining an annular electrode.

6 Claims, 6 Drawing Figures

SPRAY NOZZLE FOR ELECTROSTATIC AIRLESS COATING

BACKGROUND OF THE INVENTION

The present invention relates to a spray nozzle for electrostatic airless coating.

In a conventional spray gun for electrostatic airless coating, a flat spray nozzle is utilized for making a spindleshaped spray pattern. In this construction, however, as the discharge pressure is increased, the spraying speed of coating material is raised and the particles of the coating material tend to be out of the electric field. Consequently, the adhesion efficiency of the coating material is lowered.

On the other hand, when the discharge pressure is decreased, tails are produced on the longitudinal ends of the pattern to make the distribution of the coating material uneven and provide a rough coating surface with too coarse particles of the coating material deposited thereon. This is because the spray is sectorshaped and an electrode member, such as a corona pin, producing the electric field and charging the particles of the coating material is provided only at a single point in the vicinity of the ejection port. Namely, the flat spray nozzle necessarily produces tails as aforementioned, and since the electrode member is provided only at a single point in the vicinity of the ejection port, the electric field is deflected from the axis of the ejection port to produce an uneven distribution of the coating material.

SUMMARY AND OBJECTS OF THE INVENTION

It is an object of the present invention to provide a spray nozzle for electrostatic airless coating which can produce a uniform jet of coating material in a round pattern having no tails.

It is another object of the present invention to provide a spray nozzle for electrostatic airless coating in which particles of the discharged coating material are equally charged by electrostatic effect to adhere very effectively to the surface to be coated.

It is still another object of the present invention to provide a spray nozzle for electrostatic airless coating in which the range of ejection of coating material is broadened.

The spray nozzle according to the present invention comprises a circular ejection port and a cylindrical nozzle holder concentric with the ejection port. The nozzle holder provides a continuous or discontinuous annular electrode around the ejection port.

DESCRIPTION OF THE DRAWINGS

The invention will now be described in further detail by way of example with reference to the accompanying drawings, in which.

DESCRIPTION OF THE PREFERRED EMBODIMENT

Figure 1:
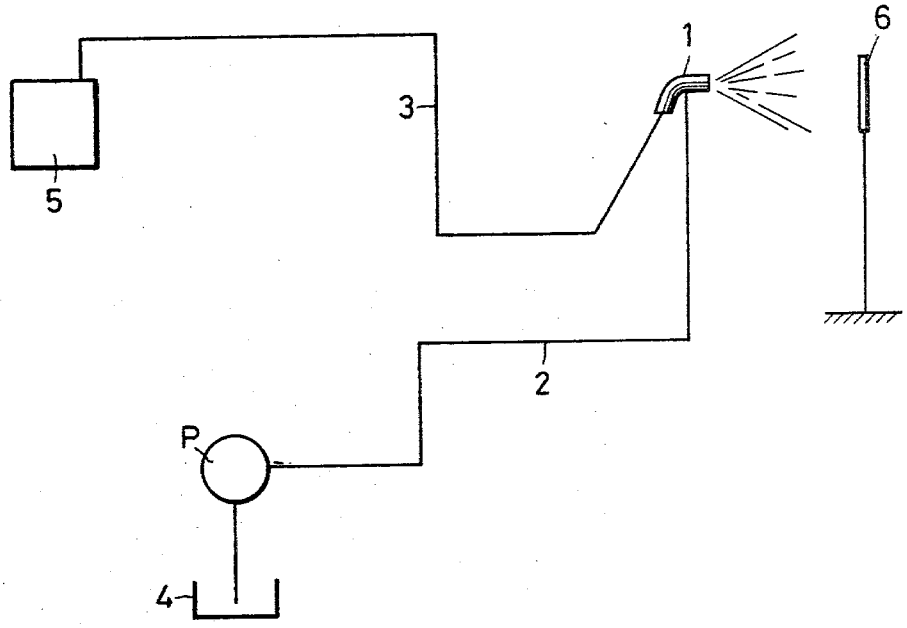
FIG. 1 is a diagrammatic illustration showing the system of electrostatic airless coating.

Referring now to FIG. 1 of the drawings, numeral 1 indicates an electrostatic airless spray gun to which one end each of a hose 2 for feeding coating material and an electrostatic cable 3 is connected. The other end of the hose 2 is connected via an airless pump P to a can 4 containing coating material while the other end of the electrostatic cable 3 is connected to a high potential generator 5. Numeral 6 indicates the object to be coated which is electrically grounded and which is placed in front of the spray gun 1.

Figure 2:
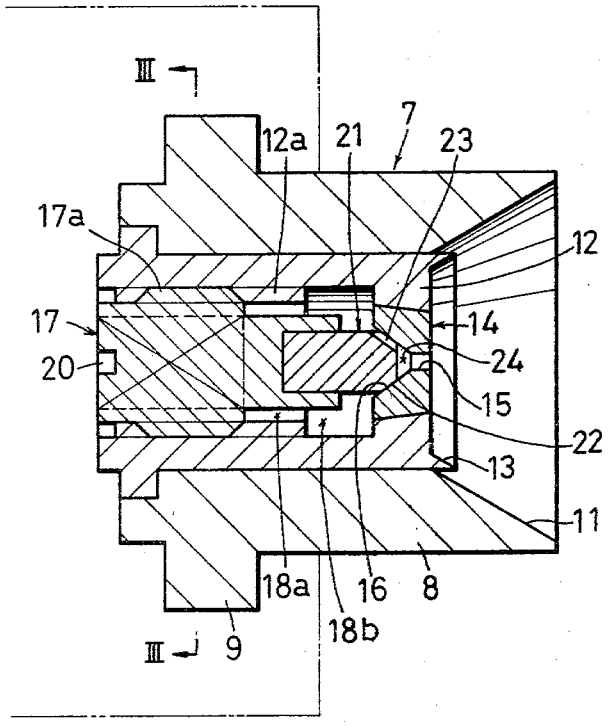
FIG. 2 is a longitudinal cross sectional view of a spray nozzle according to the present invention.

The spray gun 1 is provided at its forward end with a nozzle 7 as shown in FIG. 2. The nozzle 7 comprises a cylindrical outer casing 8 of synthetic resin which is secured to the spray gun 1 by a retaining nut mounted on the body of the spray gun 1 through a flange 9. The forward end of the outer casing 8 is beveled at 11 to have a desired taper angle.

A cylindrical nozzle seat holder 12 of stainless steel is held in the outer casing 8 under pressure. The nozzle seat holder 12 functions as a negative electrode when electrostatic coating is effected. The forward end of the nozzle seat holder 12 forms a tapered edge 13 to facilitate electric discharge, and the rear half of the nozzle seat holder 12 is provided with an internal thread **12*a***.

A nozzle seat 14 of wear-proof cemented carbide, such as tungsten carbide, is fitted in the forward portion of the nozzle seat holder 12. The nozzle seat 14 is provided with an orifice 15 and an inwardly-tapered hole 16 communicating with the orifice 15.

A nozzle tip holder 17 of stainless steel, such as 18Cr-8Ni, has a stepped outer periphery provided with an external thread **17*a* in the rear portion having a root diameter larger than the diameter of the unthreaded forward end portion. The external thread 17*a* is engaged with an internal thread 12*a* provided in the nozzle seat holder 12 to securely connect the nozzle tip holder 17 with the nozzle seat holder 12. There are two clearances 18*a* and 18*b* with respect to the unthreaded forward end portion of the outer periphery of the nozzle tip holder 17 inside the internal thread 12*a* and the forward portion of the inner periphery of the nozzle seat holder 12**.

Figure 3:
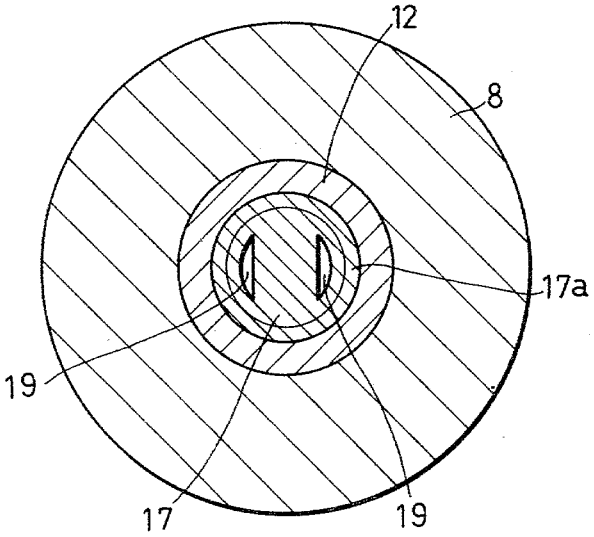
FIG. 3 is an enlarged cross sectional view taken along the lines III—III of FIG. 2.

As shown in FIG. 3, the nozzle tip holder 17 has radially inwardly of its external thread **17*a* a pair of crescent-shaped passages 19 communicating with a passage in the spray gun 1 for feeding coating material. Numeral 20 indicates a slot for receiving a screwdriver for rotating the nozzle tip holder 17**.

Figure 4:
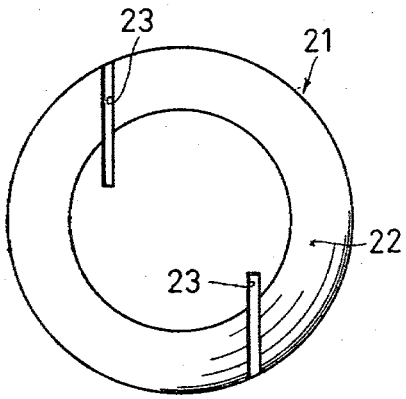
FIG. 4 is an enlarged side elevational view of the nozzle tip.

A nozzle tip 21 of tungsten carbide is secured to the nozzle tip holder 17 at its rear portion. The forward portion of the nozzle tip 21 is beveled at 22 to be engaged with the inwardly-tapered hole 16 of the nozzle seat 14. The beveled portion 22 has a pair of slits 23 (FIG. 4) provided eccentrically to rotate the coating material in a swirl chamber 24 formed in the inwardly-tapered hole 16.

In operation, the coating material fed to the spray gun 1 under pressure is discharged through the orifice 15 after passing through the passages 19, the clearances **18*a* and 18*b*, the slits 23 and the swirl chamber 24. The object 6 is coated in a round pattern since the coating material is rotated in the swirl chamber 24 as hereinabove described and the cross-section of the orifice 15** is circular. Consequently, uniform distribution of coating material can be obtained with relatively low pressure and substantially no tail will be produced around the pattern.

Since the forward end of the nozzle seat holder 12 functioning as the negative electrode is annular, the negative electrode provides a continuous concentric circle with respect to the orifice 15, so that the electric field produced between the nozzle seat holder 12 and the object 6 is enlarged with a more uniform intensity in comparison with that produced by the conventional electrode. Further, the electric field is produced symmetrically with respect to the axis of the orifice 15, while the conventional electrode deviates from the axis of the ejection port to deflect the electric field toward the electrode.

By virtue of uniformity of the electric field intensity and symmetry of the electric field, the particles of the discharged coating material are equally refined to raise adhesion efficiency of the coating material. Further, by virtue of extension of the electric field, the wrap around effect will increase greatly and the geometrical range of adhering of the coating material is broadened.

Figure 5A:
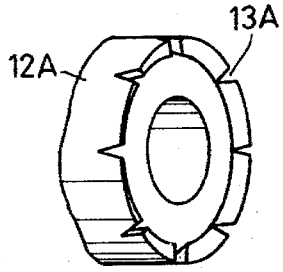
FIGS. 5A and 5B are enlarged perspective view showing other shapes of the forward end of the nozzle holder.
Figure 5B:
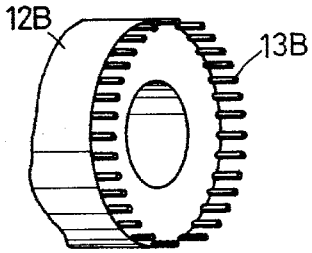

An alternative nozzle seat holder 12A may have in its forward end a plurality of slits 13A as shown in FIG. 5A to provide a discontinuous electrode. A further alternative indicated at 12B may be provided with a plurality of electrode pins 13B spaced in an annular array and extending along the longitudinal axis of the holder 12B as shown in FIG. 5B.

While the invention has been described with reference to a preferred embodiment thereof, it is to be understood that modifications or variations may be easily made without departing from the scope of this invention which is defined by the appended claims.

What is claimed is:

1. A nozzle for a spray gun for electrostatic airless coating comprising:

a member defining a circular orifice forming a single cylindrical ejection opening;

means including a swirl chamber for feeding an airless liquified coating material under pressure to said orifice for ejection from said opening; and a hollow cylindrical holder having one end which concentrically encircles said orifice and defining an annular electrode disposed in radially spaced relationship with the axis of said orifice.

2. A nozzle as defined in claim 1, wherein said one end of said holder is annularly recessed to form an annular tapered edge defining said electrode.

3. A nozzle as defined in claim 2, wherein said annular tapered edge is in the shape of a complete ring.

4. A nozzle as defined in claim 2, wherein said annular tapered edge is discontinuous, the discontinuity of said edge being defined by a plurality of slits equally or symmetrically spaced about said edge and cutting said edge into a plurality of separate portions.

5. A nozzle as defined in claim 1, wherein said one end of said holder is provided with a plurality of pins equally or symmetrically spaced along the perimeter of said one end and extending along the longitudinal axis of said holder, said pins cooperating to define said annular electrode.

6. A spray gun nozzle for depositing coating material in a round pattern on the surface to be coated, said nozzle comprising:

a cylindrical outer casing of non-conductive material having means for mounting said nozzle to a spray gun;

a hollow cylindrical holding member securely fitted in said outer casing coaxially therewith and having an internal cylindrical surface;

a generally annular member securely fitted to one end of said holding member and formed centrally therethrough with a circular opening defining a circular orifice having a cylindrical ejection opening which is coaxial with said holding member, said circular opening increasing its diameter toward the interior of said holding member to form a frustoconical opening in said annular member;

a solid cylindrical nozzle tip holder having an external cylindrical surface securely fitted in said internal cylindrical surface of said holding member, said tip holder having at its inner end a reduced diameter portion by which a first annular clearance is defined between said internal cylindrical surface of said holding member and said reduced diameter portion, said tip holder being provided with a pair of diametrically opposite, longitudinally extending passages having one end opening into said first annular clearance, while each said passage has another end capable of fluid communication with a path for coating material in the spray gun;

a solid cylindrical nozzle tip having one end secured to said inner end of said tip holder coaxially with said orifice, said nozzle tip having a generally cylindrical peripheral surface spaced apart from said internal cylindrical surface of said holding member and encircled by a second annular clearance communicating with said first annular clearance and said frustoconical opening, said nozzle tip having another end of frustconical cross-secion complementary to and snugly fitted in said frustoconical opening, said other end of said nozzle tip terminating inwardly of said orifice to define a frustoconical swirl chamber between said nozzle tip and said orifice, said other end of said nozzle tip being formed on its frustoconical surface with a pair of diametrically opposite, parallel slits extending longitudinally of said nozzle tip along the surface of said frustoconical opening and maintaining said second annular clearance and said swirl chamber in fluid connection with each other; and said holding member having one end formed with an acute annular edge encircling said orifice coaxiallu and defining an annular electrode disposed in radially spaced relationship with the axis of said orifice.

* * * * *